United States Patent [19]

Gervasio

[11] Patent Number: 4,543,204

[45] Date of Patent: Sep. 24, 1985

[54] SODIUM HIGHER FATTY ALKYL SULFATE DETERGENT LAUNDRY BARS AND PROCESS FOR MANUFACTURE THEREOF

[75] Inventor: Gregorio C. Gervasio, Metro Manila, Philippines

[73] Assignee: Colgate-Palmolive Company, New York, N.Y.

[21] Appl. No.: 524,010

[22] Filed: Aug. 17, 1983

[51] Int. Cl.[4] ..... C11D 3/065; C11D 17/00

[52] U.S. Cl. ..... 252/531; 252/174.25; 252/529; 252/DIG. 16

[58] Field of Search ..... 252/531, 529, DIG. 16, 252/174.25

[56] References Cited

U.S. PATENT DOCUMENTS

| | | | |
|---|---|---|---|
| 2,845,391 | 7/1958 | Searle | 252/539 |
| 2,941,948 | 6/1960 | Blinka et al. | 252/531 |
| 2,982,735 | 5/1961 | Blinka et al. | 252/531 |
| 3,434,974 | 3/1969 | Austin et al. | 252/539 |
| 3,442,812 | 5/1969 | Barnhurst et al. | 252/142 |
| 3,798,181 | 3/1974 | Vazquez | 252/539 |
| 4,219,436 | 8/1980 | Gromer et al. | 252/135 |

FOREIGN PATENT DOCUMENTS

| | | |
|---|---|---|
| 557593 | 11/1943 | United Kingdom . |
| 945062 | 12/1963 | United Kingdom . |
| 2048931 | 12/1980 | United Kingdom . |
| 2096163 | 10/1982 | United Kingdom . |
| 2099013 | 12/1982 | United Kingdom . |
| 2127426 | 4/1984 | United Kingdom . |

OTHER PUBLICATIONS

Belgian Patents Report No. 42/69, (General Organic).

*Primary Examiner*—Prince E. Willis

*Attorney, Agent, or Firm*—Herbert S. Sylvester; Murray M. Grill; John A. Stemwedel

[57] ABSTRACT

A detergent laundry bar, based on sodium higher fatty alcohol sulfate, which is resistant to breakage on handling, includes sodium higher fatty alcohol sulfate in which the higher fatty alcohol is of about 10 to 18 carbon atoms, water soluble builder salt for the sodium higher fatty alcohol sulfate, water insoluble particulate material which may also possess building properties, water and a higher fatty acid of 10 to 18 carbon atoms, with the proportion of higher fatty acid being such as to aid in overcoming the tendency of such laundry bars to crack, chip and break on handling. The water soluble builder salt will normally include an inorganic phosphate builder salt, such as sodium tripolyphosphate, and the water insoluble particulate material will normally include calcium carbonate and/or bentonite, and/or talc, usually being constituted of two or three of such materials. Preferably a higher fatty acid alkanolamide and a higher fatty alcohol will also be present.

Also described is a process for manufacturing such detergent laundry bars, which process includes milling and plodding operations.

13 Claims, No Drawings

SODIUM HIGHER FATTY ALKYL SULFATE DETERGENT LAUNDRY BARS AND PROCESS FOR MANUFACTURE THEREOF

This invention relates to detergent laundry bars. More particularly, it relates to a detergent laundry bar in which a principal active detersive component is a higher fatty alcohol sulfate. Laundry bars formulated with higher fatty alcohol sulfate, while capable of being made by means of detergent bar processing equipment, tend to crack, chip and break on handling after storage and before use. They are also usually deficient in foaming properties. The laundry bars of the present invention, although based on higher fatty alkyl sulfate detergent, are not subject to excessive cracking, chipping, breaking or other damage on storage and handling, are satisfactorily foaming, and are acceptable for commercial marketing.

Soap bars have long been employed for washing the human body and for "doing laundry". Before the advent of washing machines dictated the employment of detersive materials in powder, disintegrable briquette or liquid form laundry was washed with "laundry soap" bars made from a suitable soap of higher fatty acids, such as a mixed tallow and rosin fatty acids soap. Such laundry soap bars were especially suitable for being rubbed onto badly stained or soiled portions of fabrics being laundered, to deposit a high concentration of the soap on the soiled area, and they provided mechanical means for applying energy to such surfaces to assist in removing the stains and soil spots.

Despite the fact that after the introduction of synthetic organic detergents and washing machines the amount of soap employed for laundry use diminished greatly, soap in bar or cake form is still the personal cleaning agent of choice in most of the world, and laundry soaps and detergents in bar form are also still preferred by many consumers in some regions. Detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require a washing machine and, as was previously indicated, the bar form of the product allows it to be used in such manner that a comparatively high concentration of detersive material may be readily applied to a heavily stained or soiled area with accompanying physical force or energy so as more readily to loosen and remove such soil or stain.

Although branched chain alkylbenzene sulfonate detergents, such as sodium dodecylbenzene sulfonate (the dodecyl is usually highly branched propylene tetramer but can be linear too), make satisfactory detergent laundry bars such detergents have sometimes been found to be environmentally or ecologically unacceptable and accordingly, efforts have been made to formulate detergent laundry bars based on other synthetic organic detergents which would be less objectionable or would be unobjectionable environmentally. Among candidates for use as such a detergent are the higher fatty alcohol (or alkyl) sulfates, especially the sodium salts, which are biodegradable and have been successfully employed in various detergent compositions. However, until the present invention such higher fatty alkyl sulfates had not been capable of being made into commercially marketable detergent laundry bars which would be resistant to damage during handling after storage and before final use, and would possess other desirable characteristics of successful detergent laundry bars. Detergent laundry bars based on sodium higher fatty alkyl sulfate detergent appeared to change physical properties after manufacture and became susceptible to excessive breakage during ordinary shipment. Additionally, such products were often not as satisfactorily foaming as analogous laundry bars based on alkylbenzene sulfonate detergents. Now, however, by virtue of the breakthrough made by the present invention, higher fatty alkyl sulfate detergent laundry bars can be made which will withstand rough treatment during handling and shipping, and which will not be subject to undue breakage, which would diminish the marketability of such a product. Such products can also be made of satisfactory foaming and tactile characteristics.

In accordance with the present invention a detergent laundry bar which is based on sodium higher fatty alcohol sulfate and which is resistant to breaking on storage and handling comprises from 10 to 35% of sodium higher fatty alcohol sulfate wherein the higher fatty alcohol is of about 10 to 18 carbon atoms, 2 to 30% of water soluble inorganic phosphate builder salt for the sodium higher fatty alcohol sulfate, 20 to 60% of finely divided, water insoluble particulate material, 0 to 15% of non-phosphate water soluble builder and/or filler salt, 7 to 16% of moisture and 1 to 10% of higher fatty acid of 10 to 18 carbon atoms. Preferably the higher fatty alcohol sulfate is one wherein: the higher fatty alcohol thereof is primarily of 12 and/or 14 carbon atoms and saturated; the water soluble inorganic phosphate builder salt is sodium tripolyphosphate, e.g., pentasodium tripolyphosphate, desirably high in phase I; the finely divided water insoluble particulate material includes calcium carbonate and talc (and often bentonite); the higher fatty acid is a mixture of fatty acids obtained from coconut oil or palm kernel oil; and there is also contained in the detergent laundry bar higher fatty acid lower alkanolamide, higher fatty alcohol and sodium silicate. In a less preferred version of the invented composition a non-phosphate bar may be made by replacing the phosphate with other builder, such as sodium carbonate and/or sodium bicarbonate. Also within the invention is a process for manufacturing a detergent laundry bar based on higher fatty alcohol sulfate so as to make it resistant to breakage on storage and handling which comprises adding the mentioned higher fatty acid to a mixture of the other components of an otherwise unsuccessful (unduly prone to breakage) higher fatty alcohol sulfate detergent laundry bar, and milling the mixture, followed by plodding to bar form.

A search of the prior art has resulted in the finding of various patents and publications which, while they refer to detergent laundry bars and to bar products containing higher fatty alcohol sulfate detergents, do not make the present invention obvious to one of skill in the art. Among the more relevant of these are: British Patent Specifications Nos. 836,939; 941,988; 1,555,724; 1,155,726; 1,191,721; and 1,191,722; Detergent Age, September, 1965, pages 20, 21; and Schimmel Briefs, No. 364 (July, 1965). In some such disclosures the employment of sodium alkyl sulfate in detergent bars is mentioned and the disadvantages of such products are described. Detergent laundry bars based on alkylbenzene sulfonates are mentioned and various other detergents which may be employed, including alkyl sulfates, are referred to, together with adjuvants, such as higher fatty acid alkanolamides, waxes, bentonite, fatty alcohols, fatty esters and clays. However, except for British Patent Specifications Nos. 836,939 and 941,988, none of the mentioned prior art discloses fatty acids in conjunction with higher fatty alcohol sulfates in detergent bars and the mentioned references do not describe, suggest or make obvious, either alone or in combination, detergent laundry bars based on higher fatty alcohol sulfate with free fatty acid therein to prevent excessive breakages of such detergent laundry bars on shipping and handling after storage. Furthermore, none of such references, alone or in combination, discloses or makes obvious any combination of higher fatty acid, higher fatty acid lower alkanolamide and talc in a detergent laundry bar based on sodium higher fatty alkyl sulfate detergent.

The higher fatty alcohol sulfate, which is the primary detergent component of the present laundry bars, is one in which the higher alcohol or alkyl group is of about 10 to 18 carbon atoms. The cation will almost invariably be sodium or will include sodium, although other cations, such as triethanolamine (most preferred, after sodium), potassium, ammonium, magnesium and calcium, may also be present, usually in minor proportion, with the sodium detergent normally constituting more than 50%, preferably more than 75% and most preferably all or substantially all of the higher fatty alcohol sulfate content of the laundry bar.

Other synthetic organic anionic detergents of the sulfated and/or sulfonated types (and in some cases nonionic and/or amphoteric detergents) may also be present in the laundry bar as secondary detergents but the total amounts of such secondary detergents will normally be only minor, with respect to the higher fatty alcohol sulfates. Among the secondary detergents those which are preferred when biodegradability is desirable include the higher fatty alcohol ethoxy sulfates, whether based on natural or synthetic fatty alcohols, wherein the higher fatty alcohol is of 10 to 18 carbon atoms, preferably being mostly of 12 to 14 carbon atoms, and wherein the ethylene oxide content is 2 or 3 moles per mole of detergent. Among other useful sulfated and sulfonated detergents are the higher fatty acid monoglyceride sulfates of 10 to 18 carbon atoms in the fatty acid moieties, the paraffin sulfonates, olefin sulfonates and branched and linear alkylbenzene sulfonates of 10 to 18 carbon atoms in the lipophilic groups thereof, with the more biodegradable members of the alkylbenzene sulfonates being more preferred. The higher fatty acid soaps may also be present in minor proportions, and mixtures of the various secondary detergents with each other and/or with soaps (and with higher fatty alcohol sulfates) may be utilized. Higher fatty acid lower alkanolamides, such as monoethanolamides and diethanolamides, may also be included in the present detergent laundry bars but although such possess some detersive properties they will be referred to later in conjunction with their functions as improvers of other laundry bar properties (resistance to breakage and foam quality). The various secondary detersive components of the laundry bars will normally be employed as their water soluble salts, and preferably will be sodium salts. Mixtures of different types of salts may be employed, as may be mixtures of the detergents. Normally the higher fatty acyl or alkyl (or alkanol) groups in the detergents will be mixtures but essentially pure starting materials may also be employed so that the detergent, whether a primary or secondary detersive component of the products, may include a lipophilic group of essentially the same chain length.

Preferred higher fatty alcohol sulfates are those wherein the fatty alcohol is essentially saturated and is of carbon content(s) within the 10 to 18 carbon atoms range, preferably 10 or 12 to 14 carbon atoms, but some unsaturated alcohols may also be present. Lauryl sulfates, and particularly, sodium lauryl sulfate, are preferred primary detergents but such designation also may apply to such detergents wherein the carbon chain length of the alcohol is not limited to 12 carbon atoms, but is primarily (over 50% and normally over 70 or 75%) of 12 and 14 carbon atoms. Such materials may be obtained from natural sources, such as coconut oil and palm kernel oil, or may be synthesized, as from petroleum products. Often it will be preferred to employ what is characterized as a broad cut of fatty alcohols covering the $C_{10-18}$ range, such as one analyzing about 0.3% of $C_{10}$, 48 to 58% of $C_{12}$, 19 to 24% of $C_{14}$, 9 to 12% of $C_{16}$, and 5 to 13% of $C_{18}$ fatty alcohols. While saturated alcohols are highly preferred as sources for the present detergent, some unsaturated alcohols, normally less than 20% of the total content, may also be present.

Various water soluble builder salts, usually sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s), and other builder salts, if present, will also preferably be utilized in lesser proportions, with the tripolyphosphate being the major water soluble builder for the fatty alcohol sulfate. Among other inorganic builders that are useful are the water soluble carbonates and bicarbonates, sodium silicate, normally of $Na_2O:SiO_2$ ratio in the range of 1:1.6 to 1:3, preferably 1:2 to 1:3 and more preferably 1:2 to 1:2.4. Other builders, such as trisodium nitrilotriacetate (NTA), sodium polyacrylate, sodium citrate and sodium gluconate may also be utilized, as may be other water soluble salts of the corresponding acids.

In addition to the water soluble builders, some water insoluble builders may also be employed, such as detergent building calcium ion exchanging zeolites, e.g., hydrated zeolite A, X and Y, and bentonite. However, in the present description such materials will be considered with respect to their functions as excipients, bodying agents and/or processing aids, and will be described later in conjunction with such components. Although sodium sulfate, sodium chloride and other water soluble filling materials are not builders they may be components of the laundry bars and may be present with the detergents or builders utilized herein.

Various mixtures of builders may be employed to make the laundry bars of this invention but it is highly preferable that the primary builder will be hydrated pentasodium tripolyphosphate, high in type I crystal form. It has been found that such hydrated polyphosphate, which preferably is hydrated during working in with the other detergent laundry bar components, contributes substantially to the improvement of the ease of working, strength and uniform extrusion of the present laundry detergent bars. The zeolite, polyacrylate and bentonite also contribute to bodying of the product and the sodium silicate helps to act as a binder for the other components.

Water insoluble particulate material components of the present bars contribute significantly to the formation of a firm, yet processable laundry bar, and help to regulate the release of detergent from the bar during use. Zeolites and bentonites were mentioned previously as performing such function. However, the most important of the insoluble particulate materials employed is calcium carbonate. It and the other insolubles (and often soluble materials, too) will normally be in finely divided form, often with all or substantially all, e.g., over 99%, passing through a No. 200 sieve (U.S. Sieve Series) and sometimes through a No. 325 sieve. Another important insoluble material that is very desirably present in the laundry bar formulation is talc, e.g., Korean talc. This natural hydrous magnesium silicate is especially useful for promoting processing ease, improving the feel of the laundry bar, helping to improve its storage characteristics and making a better foam or lather, in conjunction with the other components of the bar. In addition to calcium carbonate and talc, which may function as excipients (although not usually "inert"), other insolubles which may be present, such as zeolites and bentonites, also may act as bodying agents to allow application of the detergent to heavily soiled laundry areas, with sufficient energy being applied to satisfactorily remove such soils without excessive dissolving and loss of the organic detergent. Of the bentonites, it is preferred to employ those which are sodium bentonites and which may be characterized as of the "swelling" type, e.g., Wyoming bentonite. Such materials have plasticizing or processing improving capabilities to a greater extent than the non-swelling calcium bentonites. However, such latter bentonites, e.g., Laviosa clays, which are preferably treated with sodium carbonate, may be employed for their bodying characteristics and for their lesser plasticizing properties and building functions.

The primary component of the present fatty alcohol sulfate laundry bars that improves their resistance to breakage is a higher fatty acid of a carbon content in the 10 to 18 carbon atoms range, or a mixture of fatty acids within such range. Such fatty acids may be those obtained from natural materials, such as coconut oil, palm kernel oil, other vegetable oils, and animal greases and fats. While coconut oil fatty acids and palm kernel oil fatty acids are preferred, commercial stearic acid (a mixture of stearic, palmitic and oleic acids) or pure stearic acid may be employed, usually in conjunction with coco fatty acids or palm kernel fatty acids. However, pure lauric acid or artificial mixtures of lauric and myristic acids may be used instead of the mixed acids derived from natural products. Often it will be preferable for the fatty acids to include at least 50% of $C_{12}$ and $C_{14}$ saturated fatty acids and preferably such proportion will be about 75% or more of the fatty acids present, with more lauric acid than myristic acid. The saturated fatty acids are highly preferred but it is within the invention to utilize unsaturated fatty acids too, normally in a minor proportion.

The higher fatty acids of 10 to 18 carbon atoms, preferably of 10 to 14 carbon atoms and more preferably of 12 to 14 carbon atoms, are preferred components of the present laundry bars and act to prevent deteriorations of the bars during handling and transportation, after manufacture and storage, but it has also been found that higher fatty acid lower alkanolamides (mono- or dialkanolamides), when employed in conjunction with the fatty acids, further improve such desirable effects. The fatty acids of the lower alkanolamides are of 10 to 18 carbon atoms, preferably being of 10 to 14 carbon atoms, more preferably 12 to 14 carbon atoms, and preferably are derived from coconut fatty acids. The lower alkanol is of 2 to 3 carbon atoms, normally being ethanol or isopropanol, with ethanol being highly preferred, and monoethanolamides are preferred. The most preferred higher fatty acid lower alkanolamide is cocomonoethanolamide, but the corresponding and homologous diethanolamides are also useful. Of course, as with the other components of the present laundry bars, mixtures may be utilized.

In addition to the higher fatty acids and higher fatty acid lower alkanolamides it is considered that the bentonites, as previously mentioned, may also help to improve the breakage resistant properties of the present laundry bars. Talc, which gives lubricity to the composition for processing and improves the feel of the bar and the quality of the foam, may also help to prevent breakage on storage and handling. Various starches, such as potato starch and corn starch, and chemically modified starches also can have such a desirable effect on the bar strength. Other such useful materials are the higher fatty alcohols of 10 to 18 carbon atoms, preferably of 12 to 16 carbon atoms, such as lauryl alcohol and cetyl alcohol. Especially useful is the combination of higher fatty acid, higher fatty acid lower alkanolamide and higher fatty alcohol, which cooperate to further improve the bar's resistance to breakage, while also improving foam and other bar properties. The higher fatty alcohols may be added to the formulations of the present invention or may accompany other components thereof as impurities or unreacted materials. For example, some free higher alcohol may be present with the higher fatty alcohol sulfate as an unreacted starting material (as sodium sulfate may be present as a byproduct).

Various adjuvants may be employed in the present detergent laundry bars for their individual desirable effects. Among such adjuvants are: colorants, such as dyes and pigments, e.g, Polar Brilliant Blue dye and ultramarine blue pigment; fluorescent brighteners, such as stilbene brighteners; whitening agents, such as titanium dioxide (anatase); antioxidants, e.g., benzohydroxytoluene; perfumes; anti-redeposition agents, e.g., sodium carboxymethylcellulose (which also may have binding properties); enzymes, e.g., protease, amylase; bactericides; fungicides, and solvents.

In addition to the above components water will be present in the laundry bar. While it is preferred to employ deionized water, tap water or city water may be utilized, preferably with the hardness content thereof being no more than 200 parts per million, as calcium carbonate, and more preferably with such hardness being less than 100 or 50 p.p.m. The water serves as a mutual solvent and plasticizing agent for various components of the detergent bar and facilitates hydration of some of the hydratable materials, such as sodium tripolyphosphate and bentonite (and starch, when present). In conjunction with the higher fatty acid, higher fatty acid lower alkanolamide and talc (and starch, if present), the water tends to maintain the detergent bar sufficiently strong so that it will resist cracking and breakage on shipment after manufacture and storage. It appears that the higher fatty acid inhibits evaporation of moisture from the laundry bar, thereby helping to keep the bar in stronger condition on storage. The alkanolamide and fatty alcohol also may have a similar effect.

The proportions of the various components in the final detergents are approximately the same as those in the mixture of materials being formulated for milling and plodding because relatively little moisture is lost in such operations. Normally the moisture loss will be between 0.5 and 3%, and most of the time the loss will be between 1 and 2%, e.g., 1.5%. If it appears during the mixing or subsequent operations that the composition is insufficiently plasticized due to low water content, additional water may be employed, which is usually added to an amalgamator, sigma-type mixer or other suitable mixing or blending device with the various other components of the laundry bar.

The final bar will have a content of higher fatty alcohol sulfate in the range of 10 to 35%, preferably 15 to 30% and more preferably 20 to 30%, e.g., 25 or 26%. Normally, up to about 15%, such as from 5 to 10 or 15%, may be of other detergent or mixture of detergents, such as those previously described. When an additional detergent is employed it will usually be present in a proportion less than that of the higher fatty alcohol sulfate. For example, one may employ about 15 to 20 or 25% of sodium lauryl sulfate with 2 or 5 to 10 or 15% of sodium lauryl diethoxy sulfate or sodium linear dodecyl benzene sulfonate (with the aliphatic detergent being preferred). Similarly, when other higher fatty alcohol sulfates than the sodium salt are employed they will preferably be present in minor proportion. It is preferred that the sole detergent be an anionic detergent and that such be a sodium higher fatty alcohol sulfate of the type described, more preferably sodium lauryl sulfate (which may include sodium myristyl sulfate, too).

The proportion of water soluble inorganic phosphate builder salt for the sodium higher fatty alcohol sulfate may range from 2 to 30%, preferably being 5 to 20% or 5 to 15%, e.g., about 9%. In some cases the phosphate may be omitted, being replaced by other suitable builder for the higher alkyl phosphate, but such products are not usually as satisfactory as those containing the phosphate. Other water soluble builders than the phosphates, such as sodium silicate, sodium carbonate and sodium bicarbonate, may be employed in proportions from 0 to 30%, preferably 0 or 2 to 15%, more preferably 4 to 10%, and filler salts may constitute part of such percentages. When sodium silicate and sodium sulfate are present, as in the preferred formulas given in the working examples, the percentage of sodium silicate will normally be in the range of 2 to 8%, preferably 3 to 6%, e.g., 4%, and that of sodium sulfate will be about 1 to 5%, preferably 1 to 3%, e.g., 2%.

The finely divided, water insoluble particulate material will be from 20 to 60% of the product, preferably being from 30 to 50% thereof, including calcium carbonate, the primary excipient present, talc and bentonite. Normally the percentage of calcium carbonate will be from 10 to 40%, preferably 10 or 15 to 30%, e.g., 19 or 20%, and the percentages of talc and bentonite will be from 2 to 10% and 5 to 20%, respectively, preferably 3 to 7% and 10 to 15%, respectively, e.g., about 5% and about 12%, respectively.

The higher fatty acid present will be from 1 to 10%, preferably 3 to 8%, more preferably 4 to 6%, e.g., about 5% of the product, and the higher fatty acid lower alkanolamide will also desirably constitute from 2 to 10%, preferably 3 to 8%, more preferably 4 to 6%, e.g., 5% of the bars. The percentage of higher fatty alcohol present will usually be low, generally being from 0.5 to 5%, preferably 0.5 to 3%, e.g., 1%. The moisture content will be from about 7 to 16%, preferably 9 to 14%, e.g., about 12 or 13%. Adjuvant content will usually be limited to 5% and preferably will be limited to 3%. Thus, the proportion of adjuvants present may be in the range of 0.5 to 3 or 5%, e.g., about 1 or 2%.

The invented detergent laundry bars can be processed with available equipment of types used for manufacturing soap and detergent bar products. Initially, a heavy duty mixer, such as one equipped with sigma-type blades or one equipped with counter-rotating paddle type agitators, is used to mix the various components, most of which are powdered but some of which may be in liquid state, sometimes as aqueous solutions. The order of addition of the various components of the laundry bars is not considered to be important so long as reasonable care is taken to prevent premature hydration of the phosphate (and any other hydratable components which desirably hydrate during working of the composition) and any excessive lumping which could occur in the mixing process. The mixing may take only a short time, but can take from one minute to an hour, with the usual mixing time being from 2 to 15 minutes. The mixed product will desirably be in separable solid form at about room temperature and will be charged, preferably by means of a multi-worm transfer conveyor, (preferably equipped with cooling means) to a multi-rolled mill, such as a five roll Lehmann mill of the soap mill type. The mill will be equipped with means for heating or cooling and normally the cooling means will be employed to maintain the ribbon temperature from the mill within the range of about 30° to 40° or 45° C. Various ribbon and chip thicknesses may be employed but usually such thicknesses will be in the range of 0.1 to 1 mm., preferably 0.2 to 0.4 or 0.5 mm. However, other thicknesses may be employed, depending on particular formulations being milled, so long as the composition is satisfactorily homogenized on the mill and any coarse particles that may be present are pulverized so that the finished product is not objectionably gritty.

The milled chips or milled material in other form is then conveyed to a double stage vacuum plodder, operating at a high vacuum, e.g., 600 to 740 millimeters of mercury vacuum, in which any entrapped air is evacuated. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut into smaller lengths, called blanks, and may be stamped to shape in a press. Before pressing the blanks are cooled in a cooling tunnel. If not pressed the cut lengths are cooled before wrapping. In either case the cooled bars are automatically wrapped, cased and sent to storage, prior to shipping.

The previous description is one for the manufacture of the laundry detergent bars of this invention when the main active ingredient, sodium lauryl sulfate, is added to the mixer in powder, flake or paste form. However, the sodium salt of the higher fatty alcohol(s) may also be formed in situ by neutralizing stabilized higher fatty alcohol sulfuric acid mix with soda ash or other suitable neutralizing agent. Such a reaction may result in the production of sodium sulfate from any excess sulfuric acid present or if excess soda ash is employed sodium carbonate will be present with the higher fatty alcohol sulfate. Unreacted higher fatty alcohol may also be present with the detergent. The described neutralization reaction may be effected in a separate reactor but may also be conducted in the mixer to be employed for mixing the other laundry bar constituents with the higher fatty alcohol sulfate.

The detergent laundry bars made in accordance with this invention have properties as good as those of detergent laundry bars based on alkylbenzene sulfonate as the primary synthetic organic detergent component. Achievement of such performance equality is a significant advance in the art because attempts have been made to manufacture higher fatty alcohol sulfate detergent laundry bars but the products resulting were unsuccessful because, among other reasons, they tended to fracture too readily on handling, and they did not foam and lather satisfactorily. It is considered that the overcoming of these two major disabilities is largely due to the presence of higher fatty acid in the product, and also due to the conjoint effects of the higher fatty acid lower alkanolamide and talc, and to the interactions of such materials with the higher fatty alcohol sulfate and other bar components. Additionally, the polyphosphate builds the detergent, firms the bar and improves processability thereof. The talc assists in processing by improving lubricity, improves the feel of the final product, increases the foam and improves its quality. The alkanolamide and bentonite, with the fatty acid, help to prevent breaking up of the bar on handling, and at the same time they improve foaming, as does the fatty acid. The silicate helps to build the bar and acts as a binder, as does the bentonite, which also functions as a fabric softener. Thus, from this description it is seen that the various components of the laundry bar interact and contribute toward the final desirable properties of the product in many ways. The result is that a desirable biodegradable synthetic organic detergent has now been made useful in detergent laundry bars whereas previously it was commercially unacceptable.

The following examples are given to illustrate the invention but are not to be considered as limiting it. Unless otherwise indicated all temperatures are in °C. and all parts and proportions are by weight.

EXAMPLE 1

| Component | Parts by Weight |
|---|---|
| Sodium $C_{12-16}$ fatty alcohol sulfate (Empicol 0266, 94% active ingredient) | 27.0 |
| Pentasodium tripolyphosphate (high phase I) | 9.0 |
| Calcium carbonate (99% through No. 200 sieve) | 20.0 |
| Bentonite (Laviosa or Wyoming) | 12.0 |
| Talc (Korean, No. 2) | 5.0 |
| Sodium silicate ($Na_2O:SiO_2$ = 1:2, 44.1% aqueous solution) | 8.0 |
| Lauryl alcohol (Laurex No. 1) | 1.0 |
| Sodium sulfate (anhydrous) | 2.0 |
| Coco fatty acids | 5.0 |
| Coco monoethanolamide (Empilan 2506) | 5.0 |
| Color solution (blue, aqueous, less than 1% colorant) | 4.7 |
| Sodium carboxymethylcellulose (detergent grade, 65% active) | 0.5 |
| Titanium dioxide (anatase) | 0.5 |
| Perfume | 0.25 |
| Antioxidant (benzohydroxytoluene) | 0.05 |

A detergent laundry bar of essentially the formula given (less up to about 2% loss in volatiles, mostly moisture) is made by a process which includes the steps of mixing, milling, plodding, cutting to lengths and (optionally) pressing to shape. Mixing is effected in a conventional soap or detergent amalgamator or mixer having a sigma-type mixing blade. The order of addition of the components is not critical but it is highly desirable that the sodium tripolyphosphate, which is hydratable, be added near the end of the mixing, shortly before the milling or equivalent working. This is done to promote uniformity of hydration of the polyphosphate in homogeneous contact with other bar components, which helps to strengthen the final bar. In the mixing operation described, the various liquid components of the formula are first added to the mixer, followed by the sodium lauryl sulfate, in powder or flake form, and the other particulate or powdered components. Mixing takes only a brief time, about five minutes, which is intentional so as to inhibit complete hydration of the polyphosphate. The contents of the mixer are fed by a multi-worm conveyor to a five-roll mill of the Lehmann type, wherein the mix is converted to ribbon and chip form. The multi-worm transfer conveyor is equipped with cooling means so as to prevent excessive sticking of the mixture to the conveyor parts.

The mill, which is also equipped with cooling means, operates at such a temperature that the final chip is at a suitable temperature, in the range of about 35° to 42° C., but in some instances higher or lower temperatures may be employed. The chip thickness is maintained in the range of 0.2 to 0.4 mm. The milled chips are then fed to a double stage vacuum plodder, which operates at a vacuum of about 700 mm. of mercury, to remove any entrapped air and to work the composition and extrude it as a bar through a heated nozzle, where the composition is heated sufficiently to facilitate extrusion as a homogeneous bar. The bar is then cooled to a suitable pressing temperature, preferably in the range of 20° to 30° C., and is pressed to final bar or cake shape, following which it is automatically wrapped, cased and sent to storage, for subsequent shipment and sale to the ultimate consumer. Alternatively, instead of being pressed to shape, the bars may be cut or essentially simultaneously cut and "printed" with a company name or other indicia, in which case the mentioned cooling may be effected after cutting and/or "imprinting".

The detergent laundry bars made are evaluated by expert evaluators and by consumers and are found to be of satisfactory utilitarian and aesthetic characteristics. Particularly, the bars are found to foam satisfactorily, to feel good to the hands of the user, to clean well, and not to be consumed too quickly. Also, it is noted that bars that are subjected to handling like that normally encountered in commercial distribution do not crack, break, powder or disintegrate so as to be unsatisfactory, whereas prior detergent laundry bars based on higher fatty alcohol sulfate as the primary synthetic organic detergent component, did not possess sufficient resistance to breakage during transportation and handling after storage, so as to be commercially acceptable. Users of the invented bars noted particularly that the foam thereof is copious and thick, the lubricity of the bar is good and its washing effect is satisfactory. Also, it appears that the bar has an improved softening effect on washed laundry. Of course, in comparative tests against other lauryl sulfate detergent laundry bars the improved appearance of the bar after storage, shipping and handling is also definitely notable.

In variations of the above formula, when the proportions of the higher fatty alcohol sulfate, pentasodium tripolyphosphate, calcium carbonate, bentonite, talc, sodium silicate, sodium sulfate, coco fatty acids, cocomonoethanolamide and moisture (present in the various materials charged) are varied ±10%, ±20% and ±30%, while being kept within the ranges previously specified, useful improved higher alkyl sulfate-based laundry bars result, which are superior to similar such bars not containing the higher fatty acids (and to such bars not containing the higher fatty acids, alkanolamide and higher fatty alcohol). When the percentages of all components except higher fatty acids are maintained constant and the percentage of higher fatty acids is varied over the range of 1 to 10%, useful improvements in the stabilities of the bars on storage and handling result, with the more significant improvements being when the fatty acids content is higher, e.g., 3 to 8 or 10%. Similarly, when the proportions of all components are kept constant except for those of the cocomonoethanolamide and talc, which are increased by 50% each, to 7.5 parts each, foaming amount and foam thickness are further improved. Also, when detergent laundry bars are made incorporating only the fatty alcohol sulfate, pentasodium tripolyphosphate, calcium carbonate, coco fatty acids and water (with enough water being employed to reach the desired moisture level in the final bar), improved stability of the bars against breakage results, compared to similar bars not containing the higher fatty acids. When the formula amounts of cocomonoethanolamide and talc are also incorporated, further improvements are noted in foaming quality and quantity, and the good effects due to the addition of the fatty acids on bar stability are retained (and the fatty acids appear also to improve the foaming).

When part (about ¼) of the higher fatty alcohol sulfate is replaced by other detergent(s), including triethanolamine higher fatty alcohol sulfate, sodium linear dodecylbenzene sulfonate, sodium lauryl diethoxy sulfate and/or other(s) of the previously mentioned synthetic organic detergents, and a portion (about ⅓) of the pentasodium tripolyphosphate is replaced by sodium carbonate, sodium bicarbonate, tetrasodium pyrophosphate, and/or sodium orthophosphate or any mixture thereof, and coco fatty acids are replaced by palm kernel fatty acids or a mixture of palm kernel fatty acids and stearic acid (with the stearic acid being ¼ of the total fatty acids) and the cocomonoethanolamide is replaced by myristyl diethanolamide, a stable detergent laundry bar of good foaming characteristics results.

EXAMPLE 2 (Control)

In the formula of Example 1, when the coco fatty acids are omitted the product resulting, after being manufactured in the manner indicated in Example 1, is unacceptable for commercial marketing as a detergent laundry bar because it tends to crack, chip and break on ordinary handling after storage. However, the addition of as little as one part of the fatty acid mixture noticeably improves the stability of the bar and further increases to 3, 5, 7 and 10 parts (or %) further improve such stability and resistance to breakage on handling. Although more than 10% of the free fatty acids may be employed, more than that proportion tends to make the bar fattier or greasier in feel and appearance than is normally desirable. Similar good results from the addition of higher fatty acid are obtainable when instead of coco fatty acids other fatty acids in the $C_{10-18}$ range are employed, either alone or in mixtures, whether saturated on unsaturated, but the saturated fatty acids are normally preferred, mostly because of their greater stability against objectionable reactions with other detergent laundry bar components (which may tend to react at the unsaturated bonds of the fatty acids). Generally, the employment of fatty acids containing more than one double bond per molecule will be avoided.

EXAMPLE 3

The experiment of Example 1 is repeated, utilizing a higher fatty alcohol sulfate wherein the higher fatty alcohol comprises about 0.3% of $C_{10}$ alcohol, about 55% of $C_{12}$ alcohol, about 23% of $C_{14}$ alcohol, about 11% of $C_{16}$ alcohol and about 10% of $C_{18}$ alcohol. The various alcohols are substantially saturated but a relatively small percentage of unsaturation may also be present. The detergent laundry bar is made in the manner described in Example 1 and the products are tested in a similar manner and are found to be satisfactory with respect to both strength and resistance to breakage on storage, and foaming power.

EXAMPLE 4

Instead of employing a previously manufactured and purified higher fatty alcohol sulfate detergent such detergents are made in situ by neutralization of the appropriate detergent acid mixes with sodium carbonate, (or other suitable neutralizing agent) to produce the detergents of Examples 1 and 3. The desired moisture content in the product is maintained by adjustment of proportions of moisture accompanying the various other components of the formulation. After manufacture of the detergents the neutralized detergent mixes, with or without partial dryings thereof, are incorporated in the mixer with the other detergent constituents, usually after cooling to near room temperature. The mixes are converted to bar forms in the manner described in Example 1. The products resulting, when tested, according to the methods described in Example 1, are found to be commercially acceptable detergent laundry bars, sufficiently strong to withstand handling and of excellent foaming characteristics, as good as those of detergent laundry bars based on branched chain dodecyl (tetrapropylene) benzene sulfonate. Also, when the 12 parts of bentonite in the formulas are replaced by 8 parts of calcium carbonate, acceptable detergent laundry bars result, although the fabric softening contributions of the bentonite are lost.

The invention has been described with respect to examples and illustrations thereof but is not to be limited to these because it is evident that one of skill in the art, with the present specification before him, will be able to utilize substitutes and equivalents without departing from the invention.

What is claimed is:

1. A detergent laundry bar which is based on sodium higher fatty alcohol sulfate and which is resistant to breaking on storage and handling which comprises from 10 to 35% of sodium higher fatty alcohol sulfate having about 10 and 18 carbon atoms, 2 to 30% of water soluble inorganic phosphate builder salt for the sodium higher fatty alcohol sulfate, 20 to 60% of finely divided, water insoluble, inorganic, particulate material, 0 to 15% of non-phosphate water soluble salt selected from the group consisting of builder salt, filler salt and mixtures thereof, 7 to 16% of moisture and 1 and 10% of higher fatty acid of 10 to 18 carbon atoms.

2. A detergent laundry bar which is based on sodium higher fatty alcohol sulfate and which is resistant to breakage on storage and handling which comprises from 10 to 35% of sodium higher fatty alcohol sulfate of about 10 to 18 carbon atoms, 2 to 30% of sodium tripolyphosphate, 20 to 60% of finely divided, water insoluble, inorganic, particulate material selected from the group consisting of calcium carbonate, bentonite, talc, and mixtures thereof, 0 to 15% of non-phosphate water soluble salt selected from the group consisting of sodium carbonate, sodium silicate, sodium sulfate and mixtures thereof, 7 to 16% of moisture and 1 to 10% of higher fatty acid of 12 to 14 carbon atoms.

3. A laundry bar according to claim 2 which comprises from 2 to 10% of higher fatty acid alkanolamide of higher fatty acid of 10 to 18 carbon atoms and of alkanol of 2 to 3 carbon atoms, and wherein the finely divided water insoluble, inorganic particulate material includes from 10 to 40% of calcium carbonate and 2 to 10% of talc.

4. A laundry bar according to claim 3 which comprises from 20 to 30% of sodium lauryl sulfate, 5 to 15% of sodium tripolyphosphate, 10 to 30% of calcium carbonate, 5 to 20% of bentonite, 3 to 8% of higher fatty acid, 3 to 8% of higher fatty acid alkanolamide, 2 to 8% of sodium silicate of $Na_2O:SiO_2$ ratio in the range of 1:1.6 to 1:3, 3 to 8% of talc, and 9 to 14% of moisture.

5. A laundry bar according to claim 4 which comprises about 25% of sodium lauryl sulfate, about 9% of high phase I content sodium tripolyphosphate, about 19% of calcium carbonate, about 12% of bentonite, about 5% of talc, about 5% of coco fatty acids and/or palm kernel fatty acids, about 5% of cocomonoethanolamide, about 4% of sodium silicate of $Na_2O:SiO_2$ ratio of about 1:2, about 1% of lauryl alcohol, about 2% of sodium sulfate, about 12% of moisture and about 1% of adjuvants.

6. A process for manufacturing a detergent laundry bar based on sodium higher fatty alcohol sulfate so as to make it resistant to breakage on storage and handling which comprises adding a higher fatty acid of 10 to 18 carbon atoms to a mixture of sodium higher fatty alcohol sulfate in which the higher fatty alcohol is of about 10 to 18 carbon atoms, water soluble builder salt for the sodium higher fatty alcohol sulfate, water insoluble, inorganic particulate material and water, milling, plodding, extruding and cutting the mixture.

7. A process according to claim 6 which comprises adding 1 to 10 parts of the higher fatty acid to a mixture of 10 to 35 parts of sodium higher fatty alcohol sulfate wherein the higher fatty alcohol is of about 10 to 18 carbon atoms, 2 to 30 parts of water soluble inorganic phosphate builder salt for the sodium higher fatty alcohol sulfate, 20 to 60 parts of finely divided, water insoluble, inorganic particulate material, 0 to 15 parts of non-phosphate water soluble builder and/or filler salt, and enough water so that the laundry bar will contain from 7 to 16% of moisture, mixing such materials, milling the mixture to ribbon or chip form, plodding the ribbons or chips resulting, extruding the plodded material into bar form and cutting the bar to lengths.

8. A process for manufacturing a detergent laundry bar based on sodium higher fatty alcohol sulfate so as to make it resistant to breakage on storage and handling, which comprises adding 1 to 10 parts of a higher fatty acid of 10 to 14 carbon atoms to a mixture of 10 to 35 parts of sodium higher fatty alcohol sulfate wherein the higher fatty alcohol is of about 10 to 18 carbon atoms, 2 to 30 parts of sodium tripolyphosphate, 20 to 60 parts of finely divided, inorganic, water insoluble particulate material which is selected from the group consisting of calcium carbonate, bentonite, talc and mixtures thereof, 0 to 15 parts of non-phosphate water soluble salt selected from the group consisting of sodium carbonate, sodium silicate, sodium sulfate and mixtures thereof, and enough water so that the laundry bar will contain from 7 to 16% of moisture, mixing such materials, milling the mixture to ribbon or chip form, plodding the ribbons or chips resulting, extruding the plodded material into bar form and cutting the bar to lengths.

9. A process according to claim 8 wherein the mixture comprises from 2 to 10 parts of higher fatty acid alkanolamide of higher fatty acid of 10 to 14 carbon atoms and alkanol of 2 to 3 carbon atoms and wherein the finely divided water insoluble, inorganic particulate material in the mixture includes 10 to 40 parts of calcium carbonate and 2 to 10 parts of talc.

10. A process according to claim 9 wherein the milling is by a multi-rolled mill and the plodding is by a vacuum plodder and the laundry bar made comprises from 20 to 30% of sodium lauryl sulfate, 5 to 15% of sodium tripolyphosphate, 10 to 30% of calcium carbonate, 5 to 20% of bentonite, 3 to 8% of higher fatty acid, 3 to 8% of higher fatty acid alkanolamide, 2 to 8% of sodium silicate of $Na_2O:SiO_2$ ratio in the range of 1:1.6 to 1:3, 3 to 8% of talc and 9 to 14% of moisture.

11. A process according to claim 10 wherein the higher fatty acid is a mixture of coco fatty acids and palm kernel fatty acids, the higher fatty acid alkanolamide is cocomonoethanolamide, the sodium silicate is of $Na_2O:SiO_2$ ratio of about 1:2, and about 1 part of lauryl alcohol is present in the mix before milling and plodding, and after milling and plodding the plodder bar is cut to blank lengths and is pressed to final form.

12. A process according to claim 6 wherein the milled, plodded, extruded and cut material is pressed to bar shape.

13. A process according to claim 7 wherein the cut bar lengths are pressed to final bar form.

* * * * *